United States Patent [19]

Volin et al.

[11] 3,930,841

[45] Jan. 6, 1976

[54] THERMOPLASTIC PREALLOYED POWDER

[75] Inventors: Timothy Earl Volin, Tuxedo; John Stanwood Benjamin, Suffern; Jay Michael Larson, Warwick; Robert Lacock Cairns, Suffern, all of N.Y.

[73] Assignee: The International Nickel Company, Inc., New York, N.Y.

[22] Filed: June 10, 1974

[21] Appl. No.: 477,596

Related U.S. Application Data

[62] Division of Ser. No. 316,077, Dec. 18, 1972, Pat. No. 3,865,575.

[52] U.S. Cl. ..... 75/.5 R; 75/.5 BA; 75/.5 BB; 75/.5 BC

[51] Int. Cl.[2] ..... B22F 9/00

[58] Field of Search ..... 75/.5 R, .5 BA, .5 BB, 75/.5 BC; 148/11.5 F

[56] References Cited

UNITED STATES PATENTS

| | | | |
|---|---|---|---|
| 3,519,503 | 7/1970 | Moore et al. | 148/11.5 F |
| 3,591,362 | 7/1971 | Benjamin | 75/.5 BA |
| 3,631,583 | 1/1972 | Haller | 29/420.5 |
| 3,639,179 | 2/1972 | Reichman et al. | 148/11.5 F |
| 3,671,230 | 6/1972 | Smythe et al. | 75/213 |
| 3,728,088 | 4/1973 | Benjamin | 29/182.5 |

*Primary Examiner*—W. Stallard
*Attorney, Agent, or Firm*—R. J. Kenny; E. C. MacQueen

[57] ABSTRACT

Prealloyed powders, particularly of compositions which are difficult to work by conventional means, are subjected to forces such that strain energy is imparted thereto by virtue of which the prealloyed powders manifest low flow stress and a high degree of thermoplasticity.

8 Claims, 1 Drawing Figure

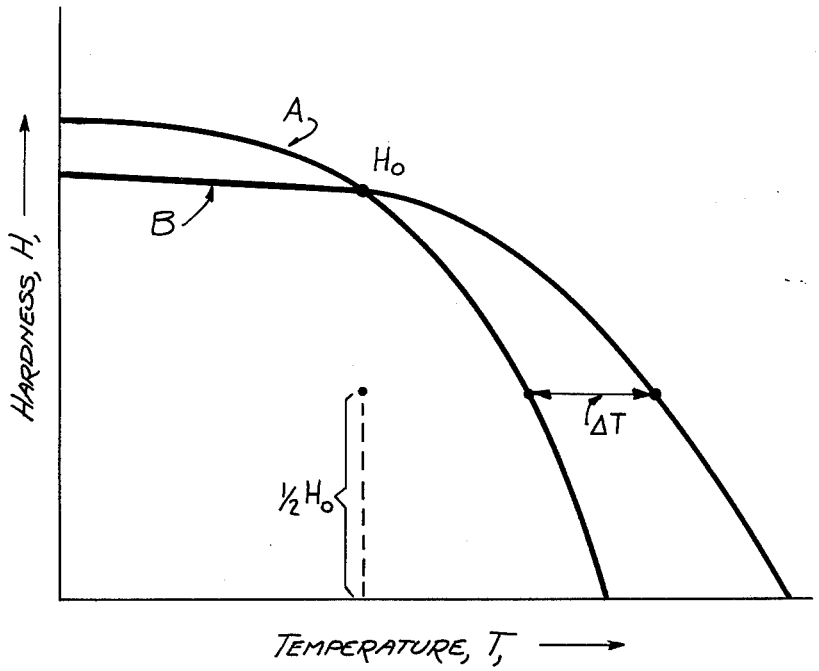
A
B
$H_o$
$\Delta T$
$\frac{1}{2} H_o$
HARDNESS, H,
TEMPERATURE, T,

THERMOPLASTIC PREALLOYED POWDER

This is a division, of application Serial No. 316,077, filed Dec. 18, 1972 which is now U.S. Pat. No. 3,865,575 issued Feb. 11, 1975.

During recent years, research efforts have been intensive in the quest for new alloys capable of meeting the stringent requirements imposed by more severe operating conditions, notably higher temperatures. And this has been particularly evident in respect of alloy development involving gas turbine engines.

To withstand the destructive effect of elevated temperature has of necessity required alloys of greater strength and hardness. But the very improvements achieved with regard to such metallurgical properties have, in turn, been responsible for placing an increasingly heavier burden upon hot workability and fabricability characteristics in general. This rather ironic development has reached the point at which the most desirable alloys, e.g., the alloy known as IN-100, virtually cannot, as a practical matter, be conventionally hot worked. As a consequence, such materials have been largely produced in cast form only. Suffice to say, casting is inherently self-limiting.

To produce the exceptionally difficultly workable alloys, the metallurgist has turned to such techniques as powder metallurgy. In this connection, the recently introduced "gatorizing" concept has been utilized and has proved to be of considerable merit. This advance appears, however, to suffer from the drawback in that the required extrusion reduction places a limitation on the section size of products that can be made with available equipment. This does focus attention on an existing problem, to wit, product shapes, and presages other difficulties arising.

In the near future it is expected that huge industrial or power turbines will be coming on stream and these may bring forth operating or processing characteristics even more demanding in certain respects than present turbine engines. For example, discs of four to five feet or more in diameter loom as a distinct probability. Yet, given the high strength requirements needed for elevated temperature operation, equipment is not presently available domestically, insofar as we are aware, having the capacity to deliver the forces necessary to satisfactorily press a compact, of say, IN-100, to such size. And as is known, the capital investment involved in this type of equipment is of considerable magnitude.

However, in accordance with the present invention, it is deemed that extremely large diameter discs (as well as much smaller turbine discs) and a host of other components can be produced without recourse to new and costly equipment. This stems from the discovery, as will be more fully described herein, that if high strain energy is induced into powder prealloyed to desired composition, e.g., virtually unworkable IN-100, the nature of the powder is altered to such an extent that the powder takes on the physical characteristic of thermoplasticity, exhibiting significantly less resistance to flow. As a direct consequence of this phenomenon, (a) lower pressing temperatures and/or forming stresses can be used than otherwise would be the case, (b) the capacity of available equipment would be capable of producing huge shapes such as 4–5 foot diameter turbine discs, (c) processed powder can be put into a preform closely corresponding to the configuration of shape of the final product, (d) the preform is capable of retaining its relative ease of deformability properties through subsequent processing, and (e) limitations introduced by being otherwise restricted in the type of apparatus that can be used, e.g., the extrusion press, are greatly minimized if not obviated.

As will be appreciated by those skilled in the art, the amount of strain energy required will be influenced by the hardness and strength of a given alloy at a given elevated temperature. And this to a considerable extent is largely a reflection of composition. To indicate generally when sufficient strain energy has been imparted to prealloyed powder to confer "thermoplasticity" as contemplated herein, reference is made to the accompanying drawing. Curve A represents prealloyed powder which has been subjected to strain energy, Curve B representing prealloyed powder of the same composition but which has not been so processed. Point $H_o$ represents a common hardness value for each of the prealloyed powders at a given temperature, the respective powders having been consolidated to a density of at least 99% of theoretical.

In accordance herewith, if an amount of strain energy has been imparted to prealloyed powder such that at the point ½ $H_o\Delta T/TM$ (the temperature differential, $\Delta T$, between the respective hardness curves divided by the absolute melting temperature of the alloy, TM) is at least 1%, the prealloyed powder is deemed thermoplastic. However, this thermoplastic condition, referred to as TPC-1 (Thermoplastic Physical Characteristic), is considered to be minimal. Preferably this ratio ($\Delta T/TM$) should be at least 2% (TPC-2) and most advantageously at least about 5% (TPC-3). This contributes greatly to minimum flow stress and lower pressing temperatures which in turn reduce the otherwise required load on a press (or equivalent functioning equipment).

It is conceivable that some materials may not show an $H_o$ hardness value. This could be the case in respect of, for example, a material in which the increase in hardness due to the strain energy input is less than that of a hardening phase destroyed during the energy input. Too, it is considered that there are alloy materials in which an $H_o$ value exists at a lower temperature than the lower limit hardness test temperature. In such instances, the $H_o$ value would be replaced by the expression $$\frac{(H_A)_{RT}}{2} + \frac{(H_B)_{RT}}{2}, (H_A)_{RT}$$

being the room temperature hardness of the prealloyed powder and $(H_B)_{RT}$ being the room temperature hardness of the same powder in the processed condition. It is to be understood that the claims appended hereto are to be so construed with regard to Thermoplastic Physical Characteristic values. Thus, at $$\frac{1}{2}\ \frac{(H_A)_{RT}}{2} + \frac{(H_B)_{RT}}{2},$$

the $\Delta T/TM$ ratio must be at least 1% in order for the processed powder to be considered thermoplastic.

It has been found that the necessary strain induced energy can be readily imparted to the prealloyed powders by employing a technique similar to the mechanical alloying process as described in U.S. Pat. No. 3,591,362 and incorporated herein by reference. This is a dry, intensive high energy milling process in which constituent powders are subjected to continuous and repeated compressive impact forces, for example, by melting media, until a composite product alloy powder of substantial saturation hardness and of a composition corresponding to the respective percentages of the initial individual constituent powders is produced. The constituent powders become most intimately interdispersed, the alloy being exceptionally dense and homogeneous. In the subject invention, attaining saturation hardness is not necessary (in certain instances it may be undesirable) and, surprisingly, though prealloyed powder is used it responds exceptionally well to strain energy being imparted thereto at room temperature.

As to the milling process, the required compressive impact forces may be applied, for example, by milling elements, normally balls formed of steel, nickel, tungsten carbide, etc., which are kinetically maintained in a high state of relative motion, at least 50 to 75% of the balls being preferably maintained out of static self-contact at any given time. This assures that the accelerative forces will cause the ball elements to continuously and repeatedly collide. Spex mills, attritor mills such as the Szegvari attritor mill, vibratory mills and planetary ball mills can be used to induce the necessary strain energy. Conventional ball mills, as a general proposition, even if they can supply the necessary energy, require too long a period to do so. This is illustrated herein in connection with the data presented in Table IV.

Of course, the important consideration is not the particular type of machine utilized but rather the degree of strain energy input to the prealloyed powders. To that end, the information given in Table I below is intended to indicate simply by way of illustration only, satisfactory processing parameters for a machine such as an attritor in which 5/16 inch dia. 52100 through hardened balls are used in conjunction with an argon - 10% methane atmosphere (other atmospheres e.g., nitrogen or nitrogen-oxygen atmospheres, can be used.

TABLE I

| Apparatus | Tank diam. | Impeller speed. rmp | Ball Powder ratio (vol.) | Time, hr. |
|---|---|---|---|---|
| 1 gal. attritor | 9 | 300–400 | 5–50 | 1–10 |
| 4 gal. attritor | 13 | 200–300 | " | 1–10 |
| 10 gal. attritor | 16 | 125–200 | " | 1–10 |
| 100 gal. attritor | 36 | 50–150 | " | 1–10 |

With regard to powder size, a broad range may be used, e.g., up to 1000 microns; it is preferred, however, in using 5/16 inch diameter 52100 balls to use powder within the range of 20 to 350 microns.

To give those skilled in the art a better appreciation of the invention, the following Examples and data are given:

EXAMPLE I

Atomized IN-100 powder containing (nominally) about 15% Co, 10% Cr, 5.5% Al, 4.75% Ti, 3% Mo, 0.02% C, 0.15% B, 0.06% Zr, balance essentially Ni, was screened to minus 325 mesh. It was then subjected to high energy impact in 1 gallon attritor for a period of about 10 hours, the impeller speed being maintained at about 350 rpm, 37 pounds of through hardened 52100 steel balls (5/16 inch dia.) being used as the impacting elements. The ball to powder (volume) ratio was about 17:1 and a flowing nitrogen atmosphere was used.

The as-attrited powder was then canned in mild steel, evacuated, heated to 600°F. under vacuum and sealed. Compaction was accomplished by heating the sealed can to 1900°F. and then upsetting the same against a blank die in an extrusion press. This was followed by vermiculite cooling. Hot hardness was determined on the as-compacted material as shown in Table II. Included for purposes of comparison are the corresponding hardness values of the IN-100 powder in the as-atomized and compacted state.

TABLE II

| Temperature, | Hardness, $R_A$ As-Atomized and Compacted | Attrited and Compacted |
|---|---|---|
| RT | 74.5 | 78.5 |
| 1000 | 73.2 | 76.2 |
| 1200 | 72.4 | 74.1 |
| 1400 | 71.0 | 69.8 |
| 1600 | 63.2 | 14.4 |
| 1800 | 37.2 | (too low to determine) |

RT = room temperature

The foregoing reflects the tremendous drop in hardness as the temperature exceeded about 1400°F. At 1600°F., hardness was already at the dramatically low level of 14.4. At 1800°F. the hardness of the strain energy induced (attrited) powder was at such a low level that it could not be determined on the Rockwell A scale. In marked contrast, it will be observed that the hardness of IN-100 in the as-atomized and compacted condition was, comparatively speaking, still quite high at the corresponding temperatures. At the temperature 1600°F., for example, the attrited powder in comparison with its as-atomized counterpart had a Thermoplastic Physical Characteristic TPC-3.

EXAMPLE II

Another batch of minus 325 mesh atomized IN-100 powder was processed as in Example I. In this instance, compacting in the extrusion press was conducted at 1950°F. Tensile specimens were prepared from the processed billet. One specimen was tested in the attrited and as-compacted state at 1800°F. Flow stresses were determined and were found to range from 4870 to 11,170 psi over strain rates of from 0.0025 to 0.625 min. $^{-1}$ At fracture, the elongation was 144% and the reduction in area was 99%. In marked contrast the flow stress for as-atomized IN-100 upset compacted at 1950°F. was from 8670 to 16,000 psi over the same strain rates, the elongation being 10% and reduction in area being 4.5%.

The rather striking difference in flow stress and/or ductility between the attrited and as-atomized powders are deemed attributable, at least in part, to the much finer grain size or dislocation structure of the attrited powder. Moreover, it is considered that there is a finer dispersion of embrittling phases as a by-product of the attriting. Compaction of the as-atomized powder is rendered most difficult at best by reason of phases on the powder surface and by the higher deforming stresses required. This contributes to subsequent problems concerning porosity and embrittlement.

For purposes of determing stress-rupture life, another tensile specimen from the attrited compacted powder was heat treated at 2100°F. for 4 hours, oil quenched, heated at 1200°F. for 24 hours, air cooled, and aged at 1400°F. for 8 hours followed by air cooling. At a temperature of 1350°F. and under a stress of 100,000 psi the specimen had a rupture life of 22.5 hours. This compares with but 2 hours for the as-atomized compacted powder treated in the same fashion. In the latter case, strength could not be improved by heat treatment.

EXAMPLE III

Batches of atomized IN-100 powder of a composition corresponding to that given in Example I, screened to minus 60 plus 325 mesh were processed in a 5-½ inch diameter "ball mill." The ball mill was run at about 80 rpm using ⅜ inch diameter, through hardened 52100 steel balls, a 10:1 ball to powder ratio and a sealed air atmosphere, the difference being that in one case the process was conducted for 5 hours as opposed to 50 hours in the second instance. Two other batches of minus 325 mesh atomized IN-100 powder were "attrited" as in Example I for periods of 1 and 3 hours, respectively. Each of the 4 batches was compacted as in Example II and hardness determinations were made at various temperatures as given in Table III. Also set forth, for convenience, are the hardness values for as-atomized and compacted (no strain induced energy) powder and the IN-100 atomized and attrited powder of Example I (attrited 10 hrs.). Finally, hardness data taken from that published for conventional as-cast IN-100 is also included.

TABLE IV

| Temp., °F. | As-Atomized | Rockwell Hardness, $R_{(A)}$ Ball Milled 5 Hr. | 50 Hr. | Attrited 1 Hr. | 3 Hr. | 10 Hr. | As Cast |
|---|---|---|---|---|---|---|---|
| R.T. | 74.5 | 74.8 | 75.8 | 76.4 | 77.2 | 78.5 | 69.5 |
| 1000 | 73.2 | 73.9 | 73.8 | 74.4 | 76.0 | 76.2 | 68.2 |
| 1200 | 72.4 | 73.8 | 73.2 | 74.1 | 74.0 | 74.1 | 68.2 |
| 1400 | 71.0 | 71.3 | 71.5 | 70.0 | 69.4 | 69.8 | 67.8 |
| 1600 | 63.2 | 61.7 | 55.7 | 47.2 | 33.0 | 14.4 | 65.0 |
| 1800 | 37.2 | 27.4 | * | * | * | * | 58.5 |

* too low to measure
R.T. = room temperature

The above results show that attriting for but one hour rendered the IN-100 powder vastly more thermoplastic than dry ball milling for 5 hours and somewhat more deformable than ball milling for the less practical period of 50 hours, this being a direct effect of the amount of strain energy induced in the respective powders. As a practical matter, the as-cast hardness remained rather unchanged over the complete temperature range of test.

In addition to the foregoing, our thermoplastic prealloyed powder is considered to be significantly morphologically or structurally different from conventional prealloyed powder in the final consolidated form. This is particularly true in respect of the so-termed superalloys which always contain carbon. In the conventional prealloyed powder the carbides generally tend to be relatively large, e.g., greater than 1 micron, and are incoherent in the matrix (atomic structure would have no relationship to the matrix structures surrounding them, it would be at random). In our thermoplastic prealloyed powder in the consolidated form much of the carbide is present in the form of finely dispersed semi-coherent particles. The reason for the difference in the carbide structure can be attributed to the great amount of deformation induced in the powder particles to introduce the high strain energy state. The pre-existing carbides in the powder are comminuted and redistributed by this deformation process. Upon subsequent heating to elevated temperature of compaction it becomes energetically favorable from a thermodynamic viewpoint for the carbides to dissolve and reprecipitate. This occurs at temperatures where atomic mobility is relatively low and chemical potential is high. This leads to the formation of a uniquely fine, coherently precipitated carbide structure. In the conventional prealloyed powder the carbides are not comminuted and are therefore retained in a relatively stable, large blocky form. Consolidation and working of conventional prealloyed powders must be done at relatively higher temperatures. Some solution of the large, blocky carbide occurs. The higher temperatures also increase atomic mobility, so that what carbide does dissolve is more likely to segregate to grain boundaries or other surfaces upon cooling.

By virtue of the thermoplastic nature conferred upon the prealloyed powders as a result of the invention, a variety of consolidation techniques can be employed, including press forging, creep forging, vacuum hot pressing, forging and rolling, hot isostatic compaction at temperatures lower than what otherwise might be the case, upsetting on an extrusion press, etc. In this connection, the smaller turbine discs can be closed die press forged with shaped rams. The as-formed disc would be virtually completely porosity free and ready for heat treatment and machining. For large discs the ultimately formed billet can be cross rolled or closed die press forged to near final shape and size. A most attractive feature in either case is the minimum of waste, the superalloys being quite costly, coupled with a minimum of finish machining.

In above describing the instant invention, the commercially well known alloy IN-100 has been used. The invention is obviously not restricted to this particular composition. To be sure, the invention is primarily directed to difficulty workable superalloys but it is applicable to alloys in general. Among the superalloys are those containing up to 60%, e.g., 1 to 25%, chromium; up to 30%, e.g., 5 to 25%, cobalt; up to 10%, e.g., 1 to 9%, aluminum; up to 8%, e.g., 1 to 7%, titanium, and particularly those alloys containing 4 or 5% or more of aluminum plus titanium; up to 30%, e.g., 1 to 8%, molybdenum; up to 25% e.g., 2 to 20%, tungsten; up to 10% columbium; up to 10% tantalum; up to 7% zirconium; up to 0.5% boron; up to 5% hafnium; up to 2% vanadium; up to 6% copper; up to 5% manganese; up to 70% iron; up to 4% silicon, and the balance essentially nickel. Cobalt-base alloys of similar composition can be treated. Among the specific superalloys might be listed IN-738 and 792, Rene alloys 41 and 95, Alloy 718, Waspaloy, Astroloy, Mar-M alloys 200 and 246, Alloy 713, Alloys 500 and 700, A-286, etc. Various of these alloys are more workable than others. Other base alloys such as titanium can be processed as well as refractory alloys such as SU-16, TZM, Zircaloy, etc. Prealloys contemplated herein can contain up to 10% or more by volume of a dispersed such as $Y_2O_3$, $TLO_2$, $La_2O_3$, etc.

Finally, it will be understood that modifications and variations of the invention may be resorted to without departing from the spirit and scope thereof as those skilled in the art will readily understand. Such are considered to be within the purview and scope of the invention and appended claims.

We claim:

1. A process particularly adapted to improving the fabricating characteristics of difficulty workable alloys which comprises forming a charge of prealloyed powder of predesired composition, subjecting the prealloyed powder charge to a force capable of inducing strain energy into the powder, and continuing the application of said force at least until the amount of strain energy imparted is sufficient so as to alter the nature of the powder such that it is characterized by a Thermoplastic Physical Characteristic of at least TPC-1, whereby in the case of a difficultly workable composition the prealloyed powder is characterized by a lower flow stress and can be further processed at lower stress and/or temperature than prealloyed powder of the same composition but without strain energy having been imparted thereto.

2. A process in accordance with claim 1 in which the strain energy induced confers a Thermoplastic Physical Characteristic of at least TPC-2 to the prealloyed powder.

3. A process in accordance with claim 1 in which the strain energy induced confers a Thermoplastic Physical Characteristic of at least TPC-3 to the prealloyed powder.

4. A process in accordance with claim 1 in which the prealloyed powder is a superalloy containing up to 60% chromium, up to 30% cobalt, up to 10% aluminum, up to 8% titanium, up to 30% molybdenum, up to 25% tungsten, up to 10% columbium, up to 10% tantalum, up to 7% zirconium, up to 0.5% boron, up to 5% hafnium, up to 2% vanadium, up to 6% copper, up to 5% manganese, up to 70% iron, up to 4% silicon and the balance essentially nickel.

5. A process in accordance with claim 4 in which the prealloyed powder contains at least 4% of aluminum plus titanium.

6. A process in accordance with claim 4 in which the prealloyed powder is selected from the group consisting of IN-100, IN-738, IN-792, Rene alloys 41 and 95, Waspaloy, Astroloy, Alloys 500, 700, 713 and 718, Mar-M alloys 200 and 246 and Alloy A-286.

7. A process in accordance with claim 1 in which the strain energy induced in the prealloyed powder is brought about by the forces imparted through dry, intensive high energy milling.

8. A process particularly adapted to improving the fabricating characteristics of difficultly workable alloys which comprises forming a charge of atomized prealloyed powder of a base alloy of predesired composition and selected from the group of nickel, cobalt and nickel plus cobalt alloys, refractory alloys and titanium alloys, subjecting the prealloyed powder charge to a compressive force to induce strain energy into the powder such that the amount of strain energy imparted is sufficient to alter the nature of the powder such that it is characterized by a Thermoplastic Physical Characteristic of at least TPC-1, whereby in the case of a difficultly workable composition the prealloyed powder is characterized by a lower flow stress and can be further processed at lower stress and/or temperature than prealloyed powder of the same composition but without strain energy having been imparted thereto.

* * * * *